United States Patent [19]

Kadykov et al.

[11] 4,412,857

[45] Nov. 1, 1983

[54] METHOD OF SMELTING FERRONICKEL IN ORE-SMELTING ELECTRICAL FURNACE UNDER A LAYER OF CHARGE

[75] Inventors: Vladimir A. Kadykov; Boris P. Onischin, both of Leningrad; Gennady P. Ermakov, Orsk; Valery D. Linev, Leningrad; Viktor P. Khristoforov, Orenburgskaya; Alexandr E. Burochkin; Sergei G. Mittsev, both of Kirovogradskaya; Gennady A. Timofeev, Orenburgskaya; Viktor R. Keller, Kirovogradskaya; Viktor P. Mikshin; Grigory I. Grodinsky, both of Leningrad, all of U.S.S.R.

[73] Assignee: Gosudarstvenny Proektny I Nauchno-Issledovatelsky Institut "Gipronikel", Leningrad, U.S.S.R.

[21] Appl. No.: 372,306

[22] Filed: Apr. 27, 1982

[51] Int. Cl.[3] ..... C22D 7/04; C21C 5/52

[52] U.S. Cl. ..... 75/11; 75/10 R

[58] Field of Search ..... 75/10–12

[56] References Cited

U.S. PATENT DOCUMENTS 3,715,200 2/1973 Archibald ..... 75/11

4,273,576 6/1981 Corrigan ..... 75/11

*Primary Examiner*—P. D. Rosenberg

*Attorney, Agent, or Firm*—McAulay, Fields, Fisher, Goldstein & Nissen

[57] ABSTRACT

Disclosed is a method of smelting ferronickel that comprises the steps of adjusting the depth of the slag bath, the depth of immersion of the electrodes thereinto and the specific power at the electrode surfaces wetted with the slag. According to this method, the depth of the slag bath is maintained within the range of from 0.6 to 1.1 of the electrode diameter, while the depth of immersion of the electrodes and the specific power at the electrode surfaces wetted with the slag are kept at such levels as to provide a mode approaching to the arc mode, but at the same time to that of the ferronickel bath temperature should be adequately high for the free ferronickel tapping. The depth of immersion of the electrodes into the slag bath of 0.1 to 0.25 of the electrode diameter and the specific power at the electrode surfaces wetted with the slag of 5.0 to 6.5 $MW/m^2$ are optimal for the hereinabove mentioned mode.

12 Claims, No Drawings

METHOD OF SMELTING FERRONICKEL IN ORE-SMELTING ELECTRICAL FURNACE UNDER A LAYER OF CHARGE

FIELD OF THE INVENTION

The present invention relates to the production of ferroalloys, and more particularly, to a method of smelting ferronickel implemented in an ore-smelting electrical furnace under a layer of charge.

BACKGROUND OF THE INVENTION

In the production of ferronickel, there is wide use of the reduction smelting of cinder, that is a pre-roasted charge of oxidized nickel ores, a reducing agent and a flux. One of the most important parameters of such an electric smelting are the depth of the slag bath, the depth of immersion of the electrodes into the slag bath and the specific power at the electrode surface wetted with the slag. In the course of the smelting, these parameters are monitored and controlled in order to maintain them in accordance with a prearranged process order. Any of such methods of smelting ferronickel in an ore-smelting electrical furnace is an analogue of the present invention.

In the known prior art methods of smelting ferronickel, inadequate attention was paid to the elimination of the detrimental effects convective of slag flows upon the lining of the electrical furnace and upon the economical characteristics of the electric smelting. The process of the electric smelting was performed in such a mode of electric resistance with which the main heat is evolved in the bulk of the slag bath. With such a mode, the depth of the slag bath is approximately from 1.2 to 2.0 of the electrode diameter, the depth of immersion of the electrodes is from 0.5 to 1.2 of the electrode diameter and the specific power at the electrode surfaces wetted by the slag does not exceed 3 $MW/m^2$ in the electrical furnaces used for smelting ferronickel, in particular, at the soviet metallurgical works. However, with such a mode of electric smelting, strong convective slag flows arise. These convective slag flows caused by the large depth of immersion of the electrodes lead, taking into account the used depth of the slag bath, to high heat losses in the region of contact of the slag bath with the electric furnace lining. Furthermore, the strong convective slag flows lead to a more quick desctruction of the electric furnace lining.

SUMMARY OF THE INVENTION

It is an object of the present invention to provide a method of smelting ferronickel in an ore-smelting electrical furnace under a layer of charge, which reduce the heat losses owing to weakening the slag convective flows in the region of contact of the slag bath with the electrical furnace lining.

Another object of the present invention is to provide a method of smelting ferronickel in an ore-smelting electrical furnace under a layer of charge, ensuring an increase in the electric furnace lining life between repairs.

A further object of the present invention is to provide a method of smelting ferronickel in an ore-smelting electrical furnace ensuring the production of ferronickel of the same composition as the known prior art methods if similar ore is used.

Yet another object of the present invention is to improve the prior art methods of smelting ferronickel in ore-smelting electrical furnaces in such a manner that their control would not be complicated and the output would not be reduced.

With these and other objects in view, there is provided a method of smelting ferronickel in an ore-smelting electrical furnace under a layer of charge, comprising the steps of adjusting the depth of the slag bath, the depth of immersion of the electrodes thereinto and the specific power at the electrode surfaces wetted with the slag, wherein, according to the present invention, the depth of the slag bath is maintained within the range of from 0.6 to 1.1 of the electrode diameter, while the depth of immersion of the electrodes into the slag bath and the specific power at their surfaces wetted with the slag are kept at parameters ensuring the possibility of maintaining such a temperature of the ferronickel bath at which the free ferronickel tapping is provided. In this event the area of contact of the slag bath with the electrical furnace lining is reduced, decreasing the heat losses. At the same time the maintenance of the electric smelting parameters approaching the parameters of the arc mode (not excluding the same) provides an intensive heat generation at the melt-charge interface in the regions of immersions of the electrodes into the slag bath and a quick melting of the change while the convective flows in the slag layer bulk are substantially reduced, especially at the furnace wall lining.

As the investigations performed show, when the primary embodiment is implemented, it is preferable to maintain the depth of immersion of the electrodes in the range of from 0.1 to 0.25 of the electrode diameter and the specific power at the electrode surfaces wetted with the slag in the range of 5.0 to 6.5 $MW/m^2$. When the electrodes are immersed into the slag bath to a depth less than 0.1 of the electrode diameter, problems are encountered with the adjustment of their position since the charge can move under the electrode and disturb its contact with the slag and, hence, the stability of the electric parameters of the furnace. When the electrodes are immersed into the slag bath to a depth more than 0.25 of the electrode diameter with the above-mentioned range of the specific power at their surfaces wetted with the slag, an overheating of the lower layers of the slag bath and the ferronickel takes place, leading to an increase in the heat losses with the smelting products and through the electrical furnace walls. At the same time, at a specific power at the electrode surfaces wetted with the slag less than 5.0 $MW/m^2$ and with the above-mentioned depth of immersion of the electrodes, the power consumed by the electrical furnace is reduced and, hence, the output thereof is reduced as well. On the other hand, at a specific power at the electrode surfaces wetted with the slag more than 6.5 $MW/m^2$, an electric arc is formed between the electrodes and the slag, leading to fistula-like breaks of gas through the charge, increasing the dust content in the waste furnace gas and its temperature. This leads, in turn, to elevated heat losses.

Other and further objects and advantages of the invention will be better understood from the following description illustrating the preferred embodiments of the invention.

DETAILED DESCRIPTION OF THE EMBODIMENTS

The present invention was implemented for smelting ferronickel under a layer of charge in an experimentalindustrial ore-smelting electrical furnace with the power of 6.5 MVA, the hearth area of 26.6 $m^2$ and three electrodes 0.5 m in diameter.

The oxidized nickel ore of one of the soviet ore deposits, that comprises 0.95% of nickel, 0.09% of cobalt, 22.5% of iron, 41.5% of silica, 15% of magnesium oxide, 5% of alumina and the accompanying impurities was used for the production of ferronickel. This ore was roasted in a tube rotating furnace at a temperature maintained within the range of from 720° to 830° C. together with a reducing agent and a flux. Limestone was used as the reducing agent, while anthracite dust coal was employed as the flux. Each of them was added to the ore in the amount of 10% of the ore weight. Then the hot cinder was loaded into the furnace and the smelting of ferronickel was performed.

In the course of the ferronickel smelting, the height of the charge layer was maintained within the range of from 1.0 to 1.2 of the electrode diameter and adjusted by adding the charge as it is melting.

The depth of the slag bath was adjusted by discharging the slag from the furnace, maintaining it at one of those of its values that correspond to the essence of the present invention and are specified in the below embodiments thereof.

The electric parameters of the bath were maintained to be close to the arc mode, but not permitting the formation of the electric arc between the electrodes and the slag, while the ferronickel bath temperature was maintained at a high level adequate for the free ferronickel tapping. It is known that the free ferronickel tapping is provided with an overheating of the ferronickel bath by 20° to 50° C. with respect to the liquidus temperature. This mode was maintained by adjusting the position of the electrodes in the slag bath and the specific power at the electrode surfaces wetted with the slag, taking into account the specified depth of the slag bath. With the specified depth of immersion of the electrodes into the slag bath the specific power at the electrode surfaces wetted with the slag was adjusted by changing the secondary winding voltage of the furnace transformer

EXAMPLE 1

In this example the parameters of the electric smelting were as follows:

- depth of the slag bath—0.8 of the electrode diameter
- depth of immersion of the electrodes into the slag bath—0.15 of the electrode diameter
- specific power at the electrode surfaces wetted with slag—6 $MW/m^2$
- secondary winding voltage of the furnace transformer—375 V The ferronickel containing 5% of nickel, 0.4% of cobalt, 4.5% of silicon, 2.1% of chromium, 2.5% of carbon, the rest being iron, was produced with these parameters.

EXAMPLE 2

In this example the parameters of the electric smelting were as follows:

- depth of the slag bath—1.1 of the electrode diameter
- depth of immersion of the electrodes into the slag bath—0.25 of the electrode diameter
- specific power at the electrode surfaces wetted with slag—6.5 $MW/m^2$
- secondary winding voltage of the furnace transformer—546 V The ferronickel containing 5.1% of nickel, 0.4% of cobalt, 4.3% of silicon, 2.0% of chromium, 2.3% of carbon, the rest being iron, was produced with these parameters. As it is seen, this composition of the ferronickel immaterially differs from the composition of the ferronickel produced in Example 1.

EXAMPLE 3

In this example the parameters of the electric smelting were as follows:

- depth of slag bath—0.6 of the electrode diameter
- depth of immersion of the electrodes into the slag bath—0.1 of the electrode diameter
- specific power at the electrode surfaces wetted with slag—5.0 $MW/m^2$
- secondary winding voltage of the furnace transformer—360 V.

The composition of the ferronickel produced in this example does not differ practically from those of the ferronickel produced in Example 1 and 2.

In order to evaluate the efficiency of the present invention, ferronickel was smelted in the same electric furnace, from the same cinder as in Examples 1 through 3 with the parameters usual for the known prior art methods:

- depth of slag bath—1.3 of the electrode diameter
- depth of immersion of the electrodes into the bath—0.65 of the electrode diameter
- specific power at the electrode surfaces wetted with slag—3.75 $MW/m^2$
- secondary winding voltage of the furnace transformer—199 V.

The ferronickel containing 5.0% of nickel, 0.4% of cobalt 4.6% of silicon, 2.1% of chromium, 2.4% of carbon, the rest being iron, was produced with these parameters.

The comparison of this composition with the compositions of the ferronickel produced in Examples 1 through 3 shows that the parameters corresponding to the present invention do not affect the quality of the product.

The comparison of other engineering and economical characteristics may be readily performed using the data of the below table.

TABLE 1.

Comparison of engineering and economical characteristics of ferronickel smelting processes

| Characteristics | Parameters corresponding to known prior art method | Parameters corresponding to method in accordance with examples of present invention: Example 1 | Example 2 | Example 3 |
|---|---|---|---|---|
| Rate of furnace lining erosion, mm per day | 0.70 | 0.35 | 0.40 | 0.30 |
| Heat losses through furnace walls in region of slag belt, $kcal/m^2 - h$ | 10,000 | 6,200 | 8500 | 4600 |
| Specific output of furnace, tons per square meter of hearth area | 3.5 | 4.5 | 5.1 | 3.9 |

As data of Table 1 show, the use of the present invention in accordance with its embodiments increases the furnace lining life by 30 to 58% and reduces the heat losses through the furnace walls by 15 to 54%. At the same time the furnace output was also higher by 11.5 to 48%.

What is claimed is:

1. A method of smelting ferronickel in an ore-smelting electrical furnace under a layer of charge, comprising the steps of:

supplying charge into the electrical furnace at it is melted down to maintain the height of the charge layer at a required level, discharging a slag as said charge is melted down to maintain the depth of a slag bath in the range of from 0.6 to 1.1 of the electrode diameter, tapping ferronickel as a ferronickel bath is increased, and adjusting the depth of immersion of the electrodes into said slag bath and the specific power at the electrode surfaces wetted with said slag so as to provide conditions ensuring the possibility of maintaining such a temperature of said ferronickel bath that is adequately high for the free ferronickel tapping.

2. A method of smelting ferronickel in an ore-smelting electrical furnace as defined in claim 1, wherein the step of adjusting the depth of immersion of the electrodes into said slag bath is performed by maintaining it in the range of from 0.1 to 0.25 of the electrode diameter, while said adjustment of the specific power at the electrode surfaces wetted with said slag is performed by maintaining it in the range of from 5.0 to 6.5 $MW/m^2$.

3. A method as defined in claim 1, wherein the height of the charge layer is maintained within the range of 1.0 to 1.2 of the electrode diameter.

4. A method as defined in claim 2, wherein the charge is supplied at a rate to maintain the height of the charge layer within the range of 1.0 tc 1.2 of the electrode diameter.

5. A method as defined in claim 1, wherein the depth of the slag bath is maintained at 0.8 and the depth of immersion of the electrodes into the slag bath is maintained at 0.15 of the electrode diameter while the specific power at the electrode surfaces wetted with the slag is 6 $MW/m^2$, 6. A method as defined in claim 4, wherein the depth of the slag bath is maintained at 0.8 and the depth of immersion of the electrodes into the slag bath is maintained at 0.15 of the electrode diameter while the specific power at the electrode surfaces wetted with the slag is 6 $MW/m^2$, to produce ferronickel containing 5% nickel, 0.4% cobalt, 4.5% silicon, 2.1% chromium, 2.5% carbon and the remainder iron.

7. A method as defined in claim 1, wherein the depth of the slag bath is 1.1 of the electrode diameter, the depth of immersion of the electrodes into the slag bath is maintained at 0.25 of the electrode diameter, and the specific power at the electrode surfaces wetted with the slag is maintained at 6.5 $MW/m^2$.

8. A method as defined in claim 4, wherein the depth of the slag bath is 1.1 of the electrode diameter, the depth of immersion of the electrodes into the slag bath is maintained at 0.25 of the electrode diameter, and the specific power at the electrode surfaces wetted with the slag is maintained at 6.5 $MW/m^2$, to produce ferronickel containing 5.1% nickel, 0.4% cobalt, 4.3% silicon, 2.0% chromium, 2.3% carbon and the rest being iron.

9. A method as defined in claim 8, wherein the voltage of the secondary winding of the furnace transformer is 546 V.

10. A method as defined in claim 1, wherein the depth of the slag bath is maintained at 0.6 and the depth of immersion into the slag bath is maintained at 0.1 of the electrode diameter, and the specific power at the electrode surfaces wetted with slag is 5.0 $Mw/m^2$.

11. A method as defined in claim 4, wherein the depth of the slag bath is maintained at 0.6 and the depth of immersion into the slag bath is maintained at 0.1 of the electrode diameter, and the specfic power at the electrode surfaces wetted with slag is 5.0 $MW/m^2$.

12. A method as defined in claim 1, wherein the secondary winding voltage of the furnace transformer is maintained at 360 V.

* * * * *